United States Patent [19]

Honse

[11] Patent Number: 4,731,944

[45] Date of Patent: Mar. 22, 1988

[54] MOTOR DRIVEN SIGN WITH SLIDING PANELS

[76] Inventor: James J. Honse, 35 SW. Partridge La., Lake Oswego, Oreg. 97034

[21] Appl. No.: 899,675

[22] Filed: Aug. 25, 1986

[51] Int. Cl.[4] ..... G09F 7/00

[52] U.S. Cl. ..... 40/488; 40/476; 40/491

[58] Field of Search ..... 40/476, 488, 491, 375, 40/508, 509

[56] References Cited

U.S. PATENT DOCUMENTS

| | | | |
|---|---|---|---|
| 2,117,187 | 5/1938 | MacLaren | 40/62 |
| 3,421,240 | 1/1969 | Bardi | 40/65 |
| 3,430,371 | 3/1969 | Phillips | 40/61 |
| 4,489,514 | 12/1984 | Honse | 40/476 |

*Primary Examiner*—John J. Wilson
*Assistant Examiner*—Wenceslao J. Contreras
*Attorney, Agent, or Firm*—James D. Givnan, Jr.

[57] ABSTRACT

Image bearing panels with interleaved strips are slidably carried by a sign base. A motor drives a crank and reciprocating arm with the arm end sequentially engageable with an abutment on each panel to shift the panel and expose the panel image. An obstruction is positionable at the completion of the last panel shifted which causes the arm to move out of its reciprocating path to engage and actuate linkage acting on the panels to collectively reposition the panels preparatory to the start of a viewing sequence.

11 Claims, 9 Drawing Figures

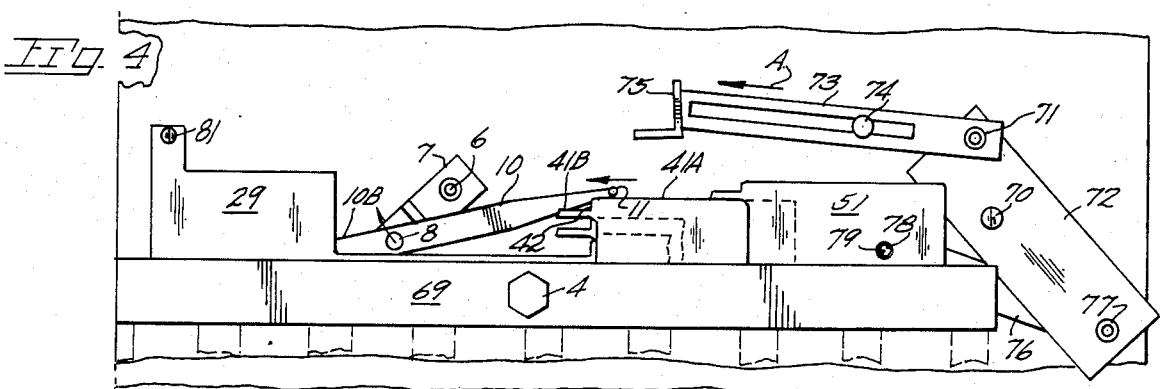
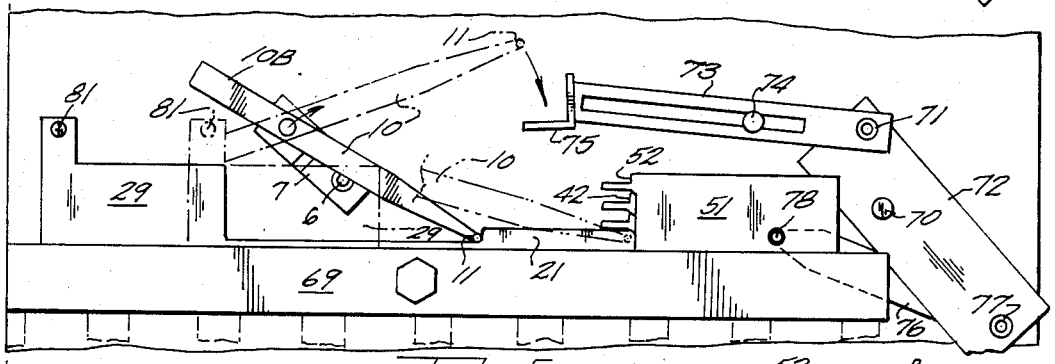
FIG. 5
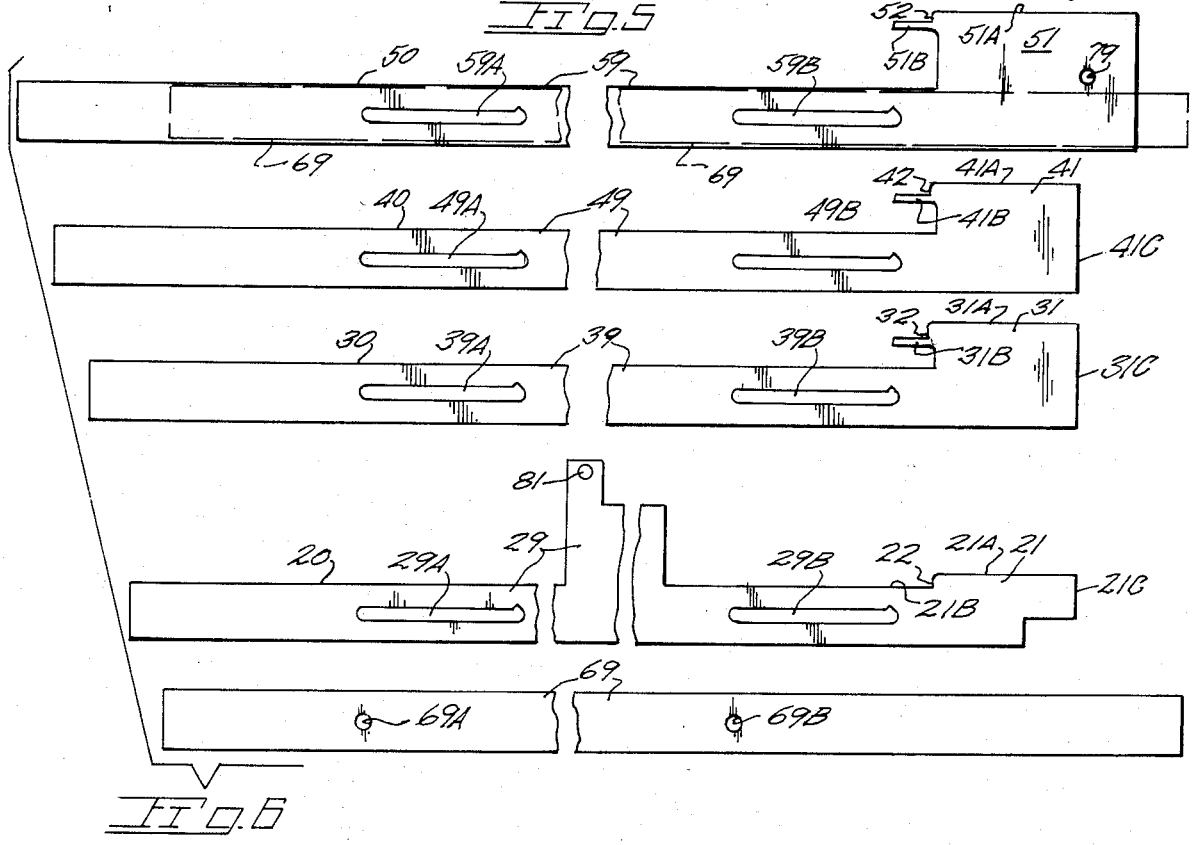
FIG. 6

MOTOR DRIVEN SIGN WITH SLIDING PANELS

BACKGROUND OF THE INVENTION

The present invention concerns motorized signs of the type having several overlapped panels each with a display and presented in a successive manner.

The present inventor is the Patentee in U.S. Pat. No. 4,489,514 which discloses a motorized sign with sliding panels for the presentation of several images with each image imprinted on a panel which is comprised of strips. The strips of one panel are interleaved with the strips of the remaining panels. Motion imparted to each panel in a successive manner moves the image thereon into view and, to complete a cycle, the panels are again moved individually into view but in reverse order.

Copending U.S. patent application No. 06/768,802 discloses a sliding panel sign utilizing similar sliding panels by having a novel panel actuating mechanism which presents the panels in the same sequence noted above. Both of the foregoing signs are somewhat more complex than the sign embodying the present invention. Other sliding panel signs are found in U.S. Pat. Nos. 2,117,187; 3,421,240; 3,430,371, all having panels with image bearing strips.

SUMMARY OF THE PRESENT INVENTION

The present invention is embodied within a sliding panel sign providing several displays with each panel being moved into view and ultimately the collection of moved sign panels being simultaneously returned to an initial starting point for restarting of a panel viewing cycle.

The sign panels are similar to the panels in the present inventor's above noted patent with each comprising a multitude of partially overlapped strips which jointly provide a display thereon. The panel strips are stacked or interleaved with corresponding strips of the other panels and have extensions at their upper and lower ends which attach the strip to upper and lower panel margins. The strips are of a flexible nature. A rigid panel member imparts shifting movement to the panel when acted on by a panel drive mechanism.

The panel drive mechanism includes a crank arrangement which operates a drive arm in a generally reciprocating manner with the arm end sequentially engaging and shifting the panels. A return stroke of the reciprocating arm repositions the arm end for subsequent engagement with a second panel to be shifted into view and so on. At the completion of shifting of all of the panels, an arm obstructing member is moved into the path of the arm to cause the latter to divert from its normal reciprocating path to cause the arm end to engage a panel return mechanism which collectively returns the panels back to their initial starting point. The panels, as well as the panel drive mechanism, are of a relatively uncomplicated nature from a manufacturing and assembly standpoints to contribute toward a sign of economical manufacture and high reliability. The drive mechanism is of low friction design suitable for use with a low voltage power source, such as a battery pack, to permit the sign to be self-contained, if desired, to avoid limitations of sign use encountered by reason of necessary proximity to a 110–120 v., power outlet.

Important objectives of the present invention include a sliding panel sign having a panel drive mechanism including a crank mechanism and panel drive arm which shift the panels with but a minimum power requirement to permit sign operation in most any store or restaurant location using a self-contained power source if desired; the provision of a sliding panel sign having a drive arm which reciprocates and is automatically positioned for driving contact with each panel to position same into view with arm travel being diverted at the completion of one cycle of panel display to actuate a panel return mechanism which shifts the collected panels back to a starting position; the provision of a sliding panel sign the panels of which have vertically spaced abutments thereon for engagement with the distal end of the drive arm.

BRIEF DESCRIPTION OF THE DRAWINGS

In the accompanying drawings:

FIGS. 4 and 5 are views similar to FIG. 2 but showing the panel drive and return mechanisms in operational positions;

FIG. 6 is an elevational view of panel carrier components acted upon by the drive mechanism;

DETAILED DESCRIPTION OF THE PREFERRED EMBODIMENTS

Figure 1:
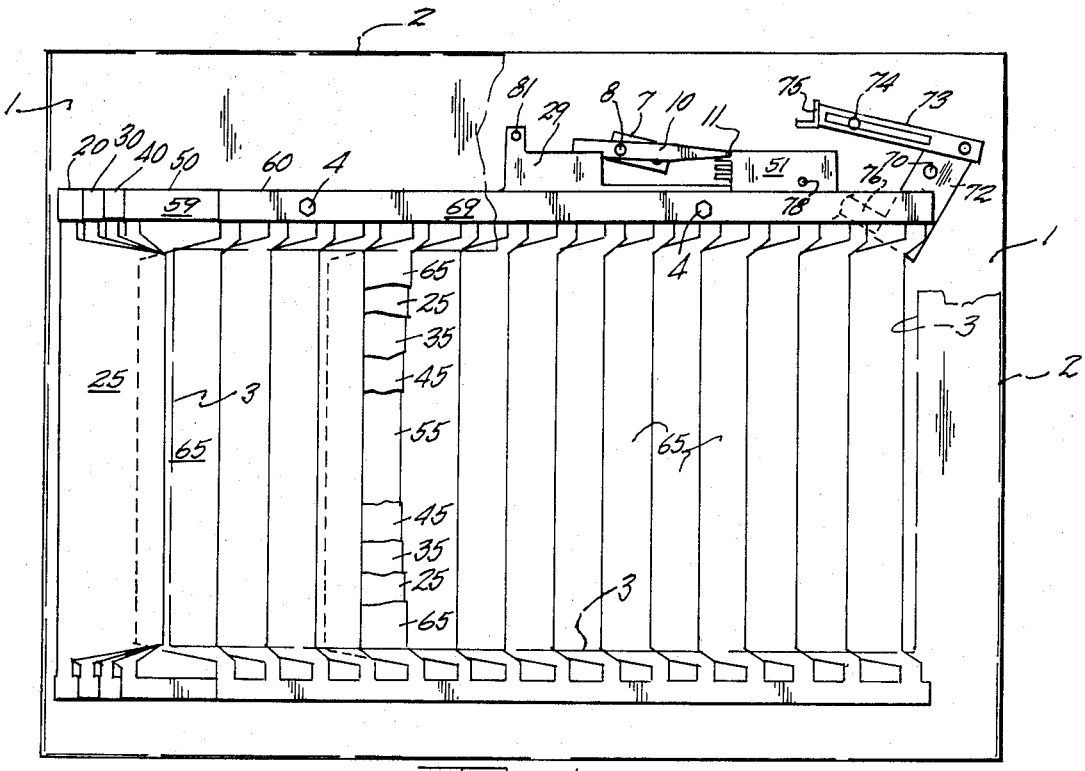
FIG. 1 is a front elevational view of the sign embodying the present invention.

With continuing attention to the drawings wherein applied reference numerals indicate parts simultaneously hereinafter identified, reference numeral 1 indicates a base of the present sign which is generally of planar configuration. For clarity of illustration, a sign cover is shown in phantom lines at 2 and defines a sight area at 3 through which the panel displays may be viewed.

In place on base 1 are panel support means 4, shown as posts, adapted at their rearward ends for securement to base 1 as by a threaded segment on each post and nut elements 5. Panel support means 4 projects perpendicularly from base 1 and serves to slidably carry the later described panels including an outermost stationary panel. The panels are each comprised of overlapped flexible strips with each set of panel strips bearing a display as later more fully described.

Figure 3:
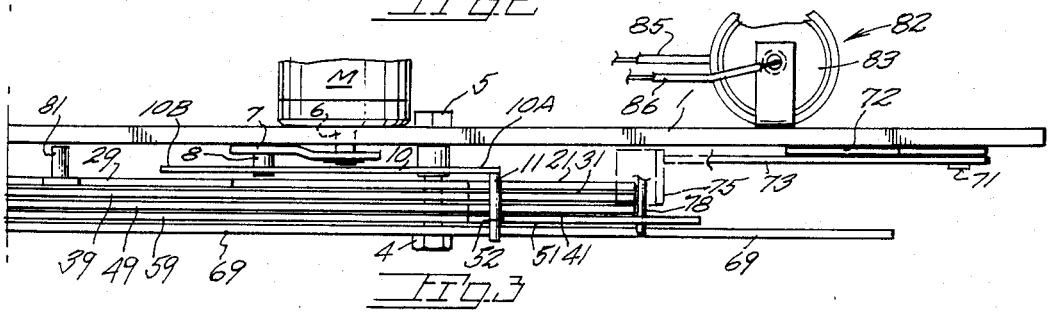
FIG. 3 is a plan view of FIG. 2.

A drive mechanism for the panels includes a motor M (FIG. 3) suitably mounted to the rear side of base 1 and having an output shaft 6. In place on output shaft 6 is a crank 7 provided with a pivot pin 8. Rotatably carried by pin 8 is a drive arm 10 having a post 11 at arm distal end 10A. A remaining end at 10B of the drive arm moves in rotary fashion and is disposed for intermittent contact with an obstruction as later described.

Figure 7:
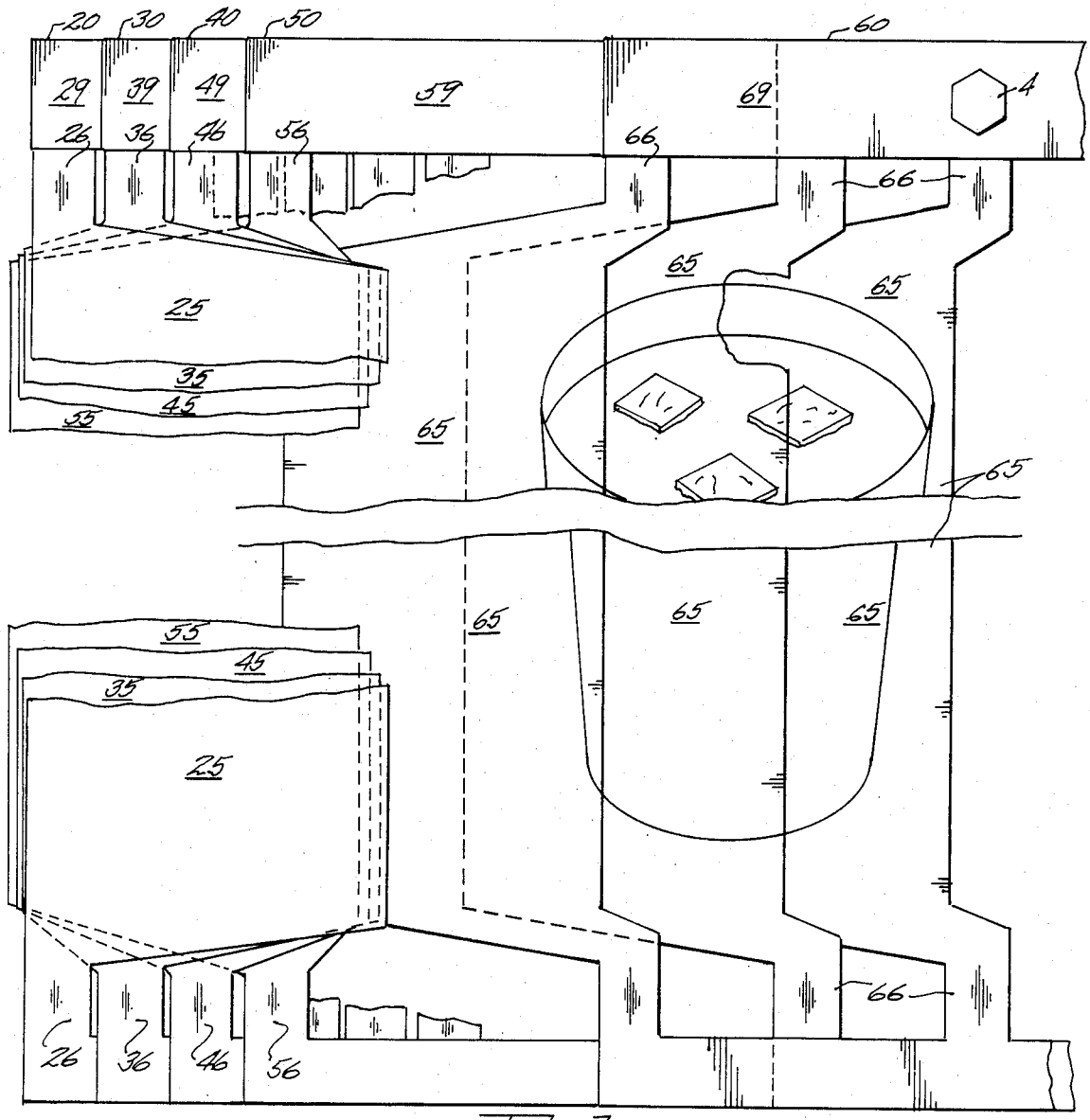
FIG. 7 is a fragmentary view of the sign panels with certain strips shown in overlapped relationship.

The sign panels are similar to those in earlier noted U.S. Pat. No. 4,489,514 which disclosure is incorporated herein by reference. Each of the movable panels at 20, 30, 40, 50 and stationary panel 60 include overlapped, flexible strips respectively at 25, 35, 45, 55 and 65. The strips of one panel are interleaved with those of the other panels and arranged generally in front-to-rear rows. Only one of such rows is shown in FIG. 7 for the sake of clarity. Also, it will be seen in FIG. 8, as typically shown, the strips of each panel overlap adjacent strips of the same panel. Typically upper and lower strip extensions as at 46 attach the strips 45 to continuous upper and lower panel margins 47 and 48. Similarly other panel extensions are shown at 26, 36, 56 and 66 with all terminating at the continuous upper and lower margins of each panel. These extensions are of a length and flexibility to yieldably carry the panel strips and may twist to a slight degree during strip movement.

Figure 2:
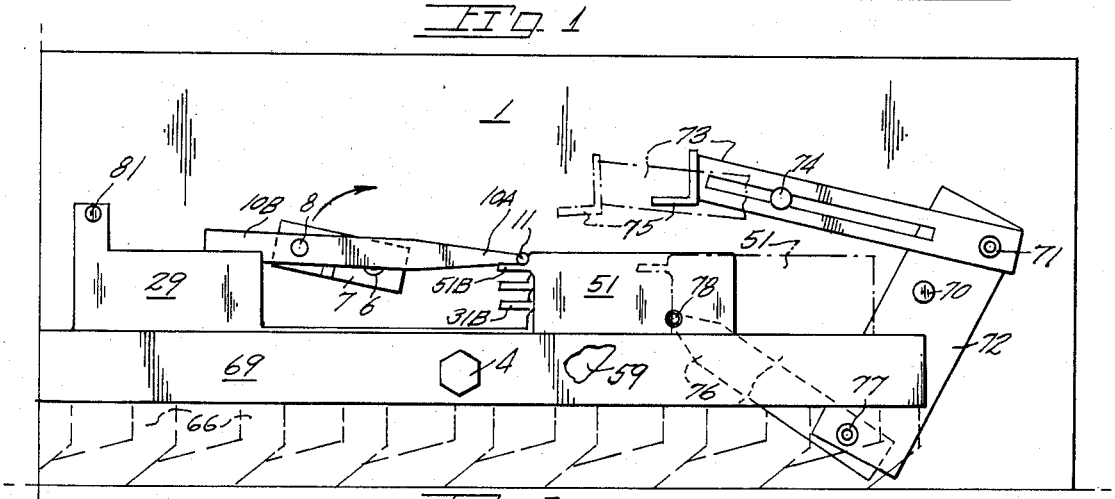
FIG. 2 is an enlarged fragmentary elevational view of the drive mechanism and the return mechanism of the sign.
Figure 8:
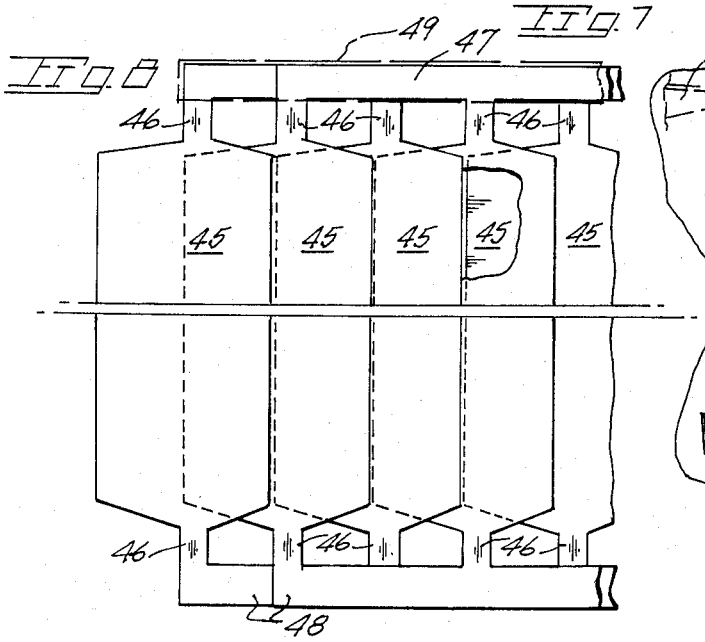
FIG. 8 is an enlarged fragmentary view of a typical sign panel of the present sign.

The strips of each panel carry a composite graphic display and, per FIG. 8, are of two ply construction i.e., the superimposed or overlapped portions of adjacent strips of one panel will carry the same superimposed image. This two ply feature, best shown in FIG. 8, permits a great number of strips per panel, and the strips of each panel to overlie adjacent strips of the same panel which of course would not be the case if the strips were cut from a single ply or sheet of panel material. The two ply concept is typically shown in FIG. 8 wherein the upper and lower continuous panel margins 47 and 48 are joined in a superimposed manner on one another and termed herein simply as a margin. Each movable sign panel 20, 30, 40 and 50 includes and is carried at its upper margin by a carrier at 29, 39, 49 and 59 (shown in FIG. 6 removed from their panels) of semi-rigid material. The carriers have slots at 29A–29B, 39A–39B, 49A–49B and 59A–59B for reception of support means 4 to slidably support their attached panels. Stationary panel 60 has a carrier at 69 with apertures 69A–69B to receive support means 4. Slightly enlarged ends of the above noted slots prevent undesired inadvertent shifting of a panel during movement of an adjacent panel. The panel carriers at 29, 39, 49 and 59 include lateral extensions at 21, 31, 41 and 51 on which are located vertically spaced apart abutments at 22, 32, 42 and 52 which receive in sequence the arm end post 11 of the drive arm. The abutments are in different horizontal planes. Each carrier extension also includes an upper edge 21A, 31A, 41A and 51A and an arm end retainer 21B, 31B, 41B and 51B. Each carrier extension includes a right hand edge 21C, 31C, 41C and 51C. In FIG. 2 arm post 11 will initially shift carrier 59 and its panel 50 to the broken line position. Continued crank movement will retract arm post 11 per the arrow thereabove in FIG. 4 along edge 41A of the next panel to be shifted whereupon it will drop onto retainer 41B as the pivot pin 8 moves through dead center and then move against abutment 42 to drive carrier 49 and its panel to the right. Such arm post and panel movement continues until all panels are relocated.

A panel return mechanism includes a main member 72 rockably supported on base 1 by means of a pivot 70. During return of the collected panels clockwise rotation is imparted to member 72 by a sliding link 73 slidably carried by a base mounted guide 74 and attached by a pivot pin 71. The link is acted on by arm 10 engaging an angle 75 on the link end. The lower end of rockable main member 72 carries a second link 76 pivotally mounted at 77. Link 76 terminates in a pin 78 which extends through an aperture 79 in panel carrier extension 51. Additionally pin 78, as viewed in FIG. 3, engages the right hand edge of the other panel extensions to collectively move the panels.

As viewed in FIGS. 2 and 4, during the initial movement of panel 50 (and its carrier 59) by arm 10, extension 51 of the carrier will move to the right to rotate main member 72 counterclockwise and reposition link 73 in the direction of arrow A of FIG. 4 whereby angle 75 will be positioned toward arm 10 to receive the momentarily elevated post 11 of the drive arm as later described.

An arm obstruction 81 of the panel return mechanism is located on panel carrier 29 of panel 20 and accordingly the obstruction is relocated to the broken line position of FIG. 5 upon shifting of panel 20 to the right by arm 10 to a displayed position. With obstruction 81 positioned to the broken line position of FIG. 5, it will be seen that the upward travel of drive arm end segment 10B will be obstructed to cause elevation of the drive arm distal end into the broken line position of FIG. 5 to assure dropping of arm post 11 onto angle 75. In this last described function, the crank 7 and pin 8 impart elevation to drive arm 10 with continued rotation of the crank moving the pivotally mounted end 10B of the drive arm 10 out of contact with obstruction 81 to permit post 11 on the distal end of the drive arm to move vertically into place on angle 75. Continued rotation of the crank 7 imparts sliding motion to link 73 and clockwise rotational movement to main member 72 to terminate in the FIG. 2 full line position. Link 76 and pin 78 thereon are accordingly positioned in a lefthand direction with pin 78 shifting the collected panels back to their initial position.

Motor M is preferably of the DC type powered by a battery pack indicated generally at 82 suitably mounted on sign base 1 and containing five D-cell batteries as at 83 in a tubular holder 84 to provide an adequate power source for the motor. Motor leads are at 85 and 86. Obviously motor choice will be determined by panel size and number as well as sign location and most convenient power supply.

Figure 9:
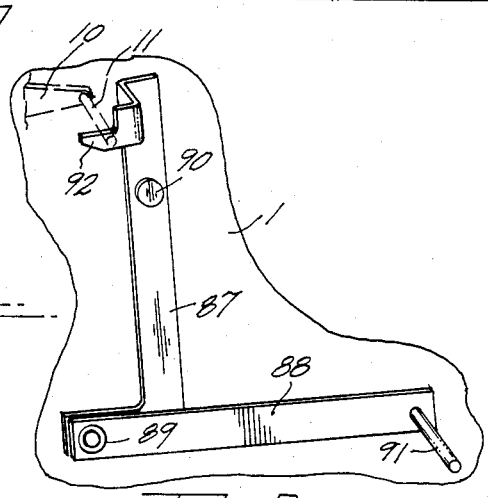
FIG. 9 is a perspective view of a modified form of linkage in a modified panel return mechanism.

With attention to FIG. 9 wherein a modified panel return mechanism is shown which includes linkage comprised of links at 87 and 88 carried by a pivot 90 in place on sign base 1. A pivot pin 89 joins the links 87 and 88. A pin 91 corresponds to pin 78 of the first described form of the panel return mechanism and functions to impart return movement to the collection of sign panels from the second to the first or initial position. An extremity 92 of link 87 is shaped so as to receive arm carried post 11 in the manner earlier described utilizing angle 75. This latter form of linkage is of fewer components and more compact than the first described linkage.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

1. A sign providing sequential displays, said sign comprising, a base, panel support means on said base, panels each including a margin extending lengthwise of each panel and each panel including a multitude of strips having a composite image thereon, the strips of one panel being slidably interleaved with strips of the remaining panels in a predetermined order, carrier means on a margin of each panel and including an abutment, a panel drive mechanism including power source, a crank driven by said power source, a panel drive arm carried by said crank and driven in a reciprocating manner thereby, said drive arm having a distal end for momentary sequential engagement with each carrier means abutment to shift each panel along said panel support means from a first position to a second position to displace the image bearing strips of each panel into view, and a panel return mechanism on said base serving to collectively return the shifted panels from said second position to said first position.

2. The sign claimed in claim 1 wherein the carrier means abutment on each panel is vertically spaced from like carrier means abutments on other panels with reciprocating motion of the drive arm distal end being in different planes, said carrier means on each panel additionally having an edge surface slidably supporting said drive arm immediately prior to drive arm engagement with the abutment on the carrier.

3. The sign claimed in claim 2 wherein said drive arm is momentarily engageable with said panel return mechanism to actuate same to return said panels to said first position.

4. The sign claimed in claim 3 wherein said drive arm has an end segment oppositely disposed from said distal end of the drive arm, and said panel return mechanism including an obstruction positionable during panel movement into the path of said drive arm end segment whereby continued rotation of the crank will impart lateral movement to the drive arm for engagement of the arm distal end with said panel return mechanism.

5. The sign claimed in claim 1 wherein said panel return mechanism includes linkage acting simultaneously on said panels, said linkage including a link positionable into the path of said panel drive arm during shifting of a panel whereupon said panel drive arm will engage and reposition said linkage to return all of the panels to said first position.

6. The sign claimed in claim 5 wherein said panel return mechanism additionally includes an arm obstruction positionable at intervals of sign operation into the path of the arm to alter arm travel for the purpose of arm engagement with said link.

7. The sign claimed in claim 6 wherein said obstruction is carried by one of said panels, said obstruction engaged by an end segment of said drive arm.

8. A sign providing sequential displays, said sign comprising, a base, panel support means on said base, panels each including a margin extending lengthwise of each panel and each panel including a multitude of strips having a composite image thereon, the strips of one panel being slidably interleaved with strips of the remaining panels in a predetermined order, carrier means on the margin of each panel and including an abutment, a panel drive mechanism having a power source, a panel drive arm powered in a reciprocating manner and sequentially engageable with said abutment on each of said carrier means on said panels to move the panels in sequence in one direction, a panel return mechanism acting on said panels to collectively shift the panels in an opposite direction, an obstruction positionable into the path of said drive arm to alter arm travel for arm engagement with said panel return mechanism to actuate the latter.

9. The sign claimed in claim 8 wherein said panel drive mechanism includes a crank, said panel drive arm pivotally coupled to said crank and having an end segment contactible with said obstruction with subsequent crank rotation elevating the drive arm for engagement with the panel return mechanism.

10. The sign claimed in claim 9 wherein said obstruction is carried by one of said panels, said one of said panels being the last panel shifted.

11. The sign claimed in claim 8 wherein said panel return mechanism includes linkage rockably mounted on said base, said linkage actuated in one direction by said panel drive arm to collectively shift the panels, said linkage actuated in an opposite direction by one of said panels.

* * * * *